United States Patent [19]

Lewis

[11] 4,444,277

[45] Apr. 24, 1984

[54] APPARATUS AND METHOD FOR CONDITIONING OIL WELL DRILLING FLUID

[76] Inventor: H. Roger Lewis, #3 Prows Cir., Layton, Utah 84041

[21] Appl. No.: 304,657

[22] Filed: Sep. 23, 1981

[51] Int. Cl.[3] ..... E21B 7/00

[52] U.S. Cl. ..... 175/66; 175/206

[58] Field of Search ..... 175/66, 88, 206, 207; 137/268, 888

[56] References Cited

U.S. PATENT DOCUMENTS

| | | | |
|---|---|---|---|
| 2,571,247 | 10/1951 | Huebotter | 175/66 |
| 2,683,622 | 7/1954 | Dragon | 137/268 X |
| 2,786,651 | 3/1957 | Mickle | 175/206 |
| 2,923,151 | 2/1960 | Engle et al. | 175/206 |
| 3,267,615 | 8/1966 | Moore | 137/268 X |
| 4,353,803 | 10/1982 | Dover, Jr. | 175/66 X |
| 4,357,953 | 11/1982 | Patterson | 137/268 X |

*Primary Examiner*—Stephen J. Novosad
*Assistant Examiner*—Thuy M. Bui
*Attorney, Agent, or Firm*—A. Ray Osburn

[57] ABSTRACT

An apparatus and associated method for conditioning or reconditioning oil well drilling mud, comprising multiple hoppers for holding dry additive. Each hopper has a mechanism permitting the additive to be fed into an entrainment chamber at controlled, pre-selected rates. The additives are thus mixed at controlled rates with a free jet of mud forced across the entrainment chamber, to quickly achieve the desired density, viscosity and other properties of the mud. An augur is used to force the dry additive through an adjustable gate valve to control the additive flow rate. Or, the augur may be rotated at selected rates, and a fixed area additive flow passage employed between the hopper and the entrainment chamber.

26 Claims, 12 Drawing Figures

APPARATUS AND METHOD FOR CONDITIONING OIL WELL DRILLING FLUID

BACKGROUND OF THE INVENTION

1. Field

The field of the invention is oil well drilling equipment and more particularly apparatus for preparation and handling of oil well drilling fluid.

2. Prior Art

The drilling process to tap underground reservoirs of oil involves the pumping of a high density, high viscosity, semi-fluid mixture of solids, water and other fluids, called "mud," downwardly through hollow drill stem segments and outwardly through passages provided in the drill head, by which it is cooled, lubricated and cleaned. The mud is forced by the pumping pressure upwardly around the drill stem through the drill bore and thence out of the well. The used mud is processed to remove entrained gases, sand and silt. It is then reconditioned by addition of finely divided solid materials to readjust its viscosity, density, and acid potential for reuse. Typically, the used mud is collected in a reservoir and then pumped at high pressure to form a jet through the bottom portion of an additive entrainment chamber. The finely divided solid additives are manually poured from bags into the chamber in a stream to be entrained by the high pressure jet. The additives tend to be introduced at non-uniform, erratic rates, so that the resulting mud composition, and its properties are insufficiently controlled. Recirculation and readjustment is often required to achieve proper mud properties. Since two or more additives are often required, the reconditioning by the present process is even more laborious, uncertain and time consuming.

BRIEF SUMMARY OF THE INVENTION

With the foregoing in mind, the disadvantages of prior apparatus and methods for conditioning oil well drilling fluids are eliminated or substantially alleviated in the present invention by providing improved apparatus and methods permitting additive materials to be introduced into the fluids at accurately controlled rates. One or more hoppers are provided, each to hold a supply of a selected finely divided dry additive, each having means for transporting the powdered additive from the hopper at preselected substantially uniform rates into the entrainment chamber for subsequent thorough mixing with the mud jet, to quickly and accurately adjust the properties of the mud. An additive forcing means in each hopper cooperates with adjustable area passage means to determine the feed rate of the additive from the hopper into the entrainment chamber. According to another embodiment of the invention, the adjustment in feed rate is provided using fixed area passage means between each hopper and the entrainment chamber, in combination however with adjustable additive forcing means. Powered auger or belt conveyor apparatus may be employed for forcing the additive powders. Gate type valving may be used to provide passage area adjustment.

The apparatus and method may be used for adjusting the properties of newly mixed mud, but is more often used for reconditioning used mud from which unwanted silt, and and gasses have been removed. The required proportions of dry additives to the mud are then determined, preferably by chemical and physical testing, but in some cases wholly or partially by feel or "rule of thumb," and the necessary flow rate of each additive into the entrainment chamber then calculated to correspond to the flow rate of the mud in the jet. Calibration of the valve settings, or the additive forcing apparatus for each additive where a fixed passage is employed, enable the operator to cause each additive to be introduced into the jet at the pre-determined required rate.

A principal object of the invention is to provide apparatus and associated methods enabling the conditioning of oil well drilling fluids with increased accuracy leading to greatly reduced time and increased economy in the conditioning and reconditioning process, said apparatus and methods permitting pre-determination of the required amounts, proportions, and associated flow rates of dry additives along with their subsequent entrainment and mixing into the fluids at said required rates.

BRIEF DESCRIPTION OF THE DRAWINGS

In the drawings, which represent the best mode presently contemplated for carrying out the invention.

DETAILED DESCRIPTION OF ILLUSTRATED EMBODIMENTS

Figure 1:
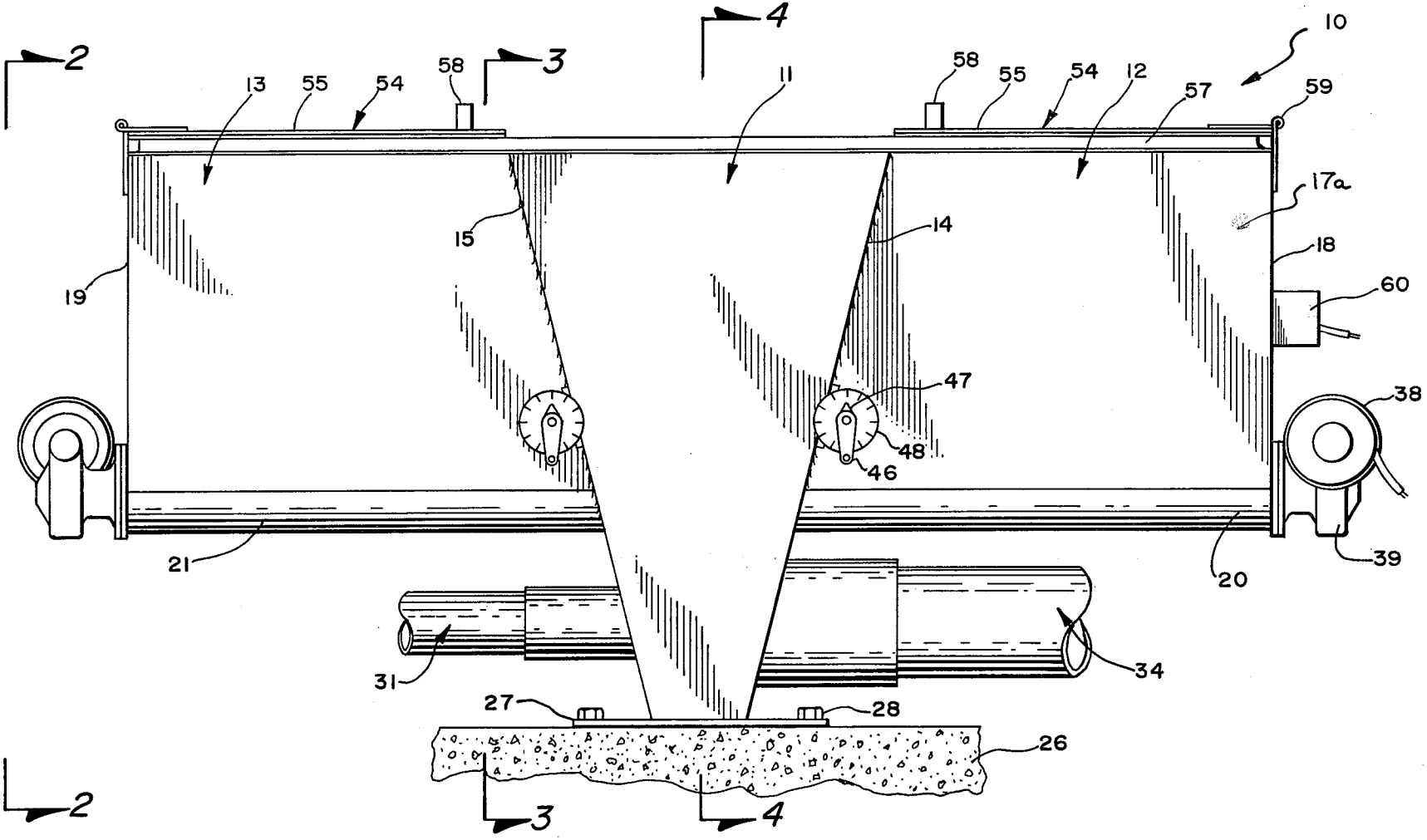
FIG. 1 is a front elevation view of an oil well drilling fluid conditioning apparatus in accordance with the invention, FIG. 2 a side elevation view of the conditioner of FIG. 1, drawn to the same scale, FIG. 3 a vertical cross sectional view of the conditioner of FIG. 1 taken along line 3—3 thereof, drawn to the same scale, FIG. 4 a vertical cross sectional view of the conditioner of FIG. 1 taken along line 4—4 thereof, drawn to the same scale, FIG. 5 a vertical cross sectional view of the conditioner of FIG. 2, taken along line 5—5 thereof, drawn to the same scale, FIG. 6 a fragment of a vertical cross sectional view of the conditioner of FIG. 1 taken along line 6—6 of FIG. 4, drawn to an enlarged scale, FIG. 7 a fragment of a vertical cross sectional view of the conditioner of FIG. 1 taken along line 7—7 of FIG. 6, drawn to the scale of FIG. 6, FIG. 8 a fragment of the cross sectional view of FIG. 5 taken at area 8 thereof, drawn to an enlarged scale, FIG. 9 a fragment of a cross sectional view of the conditioner of FIG. 1 taken along line 9—9 of FIG. 5, drawn to an enlarged scale, FIG. 10 a schematic representation indicating the use and reconditioning of oil well drilling fluid and illustrated the prior art apparatus and method for conditioning oil well drilling mud, FIG. 11 a fragment of a vertical cross sectional view of another embodiment of the mud conditioning apparatus, and FIG. 12 a vertical cross sectional view of the belt conveyor of FIG. 11, taken along line 12—12 thereof, drawn to the same scale.
Figure 4:
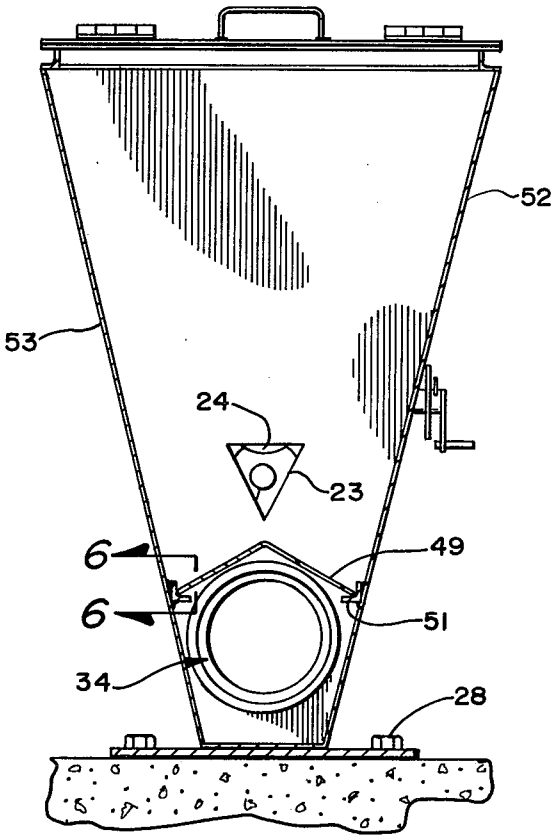
Figure 3:
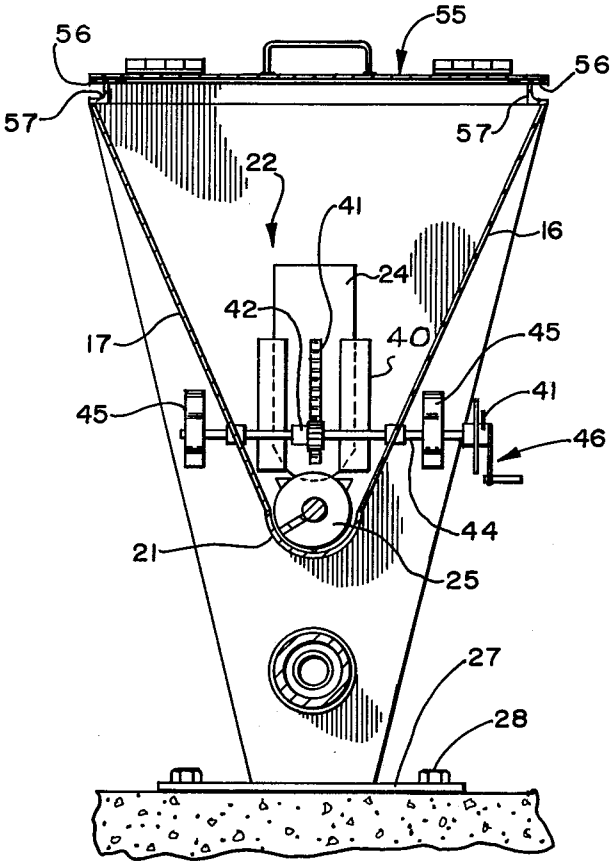
Figure 2:
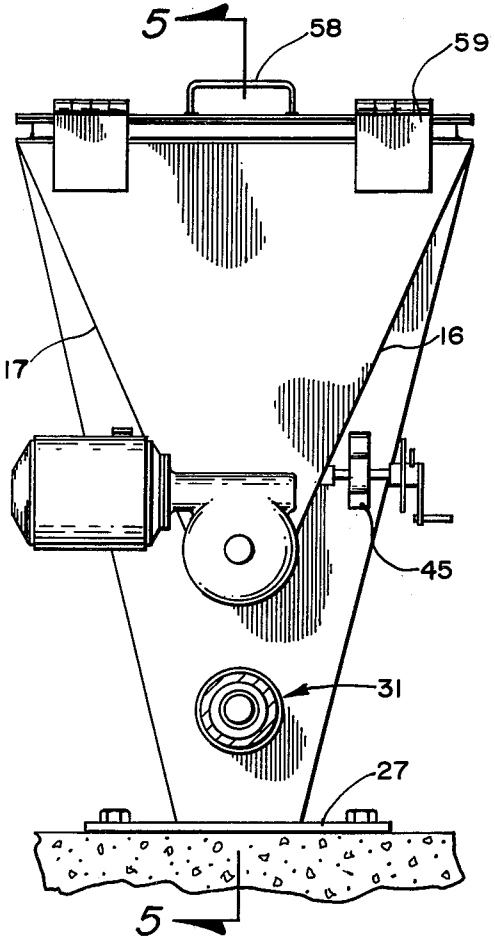
Figure 5:
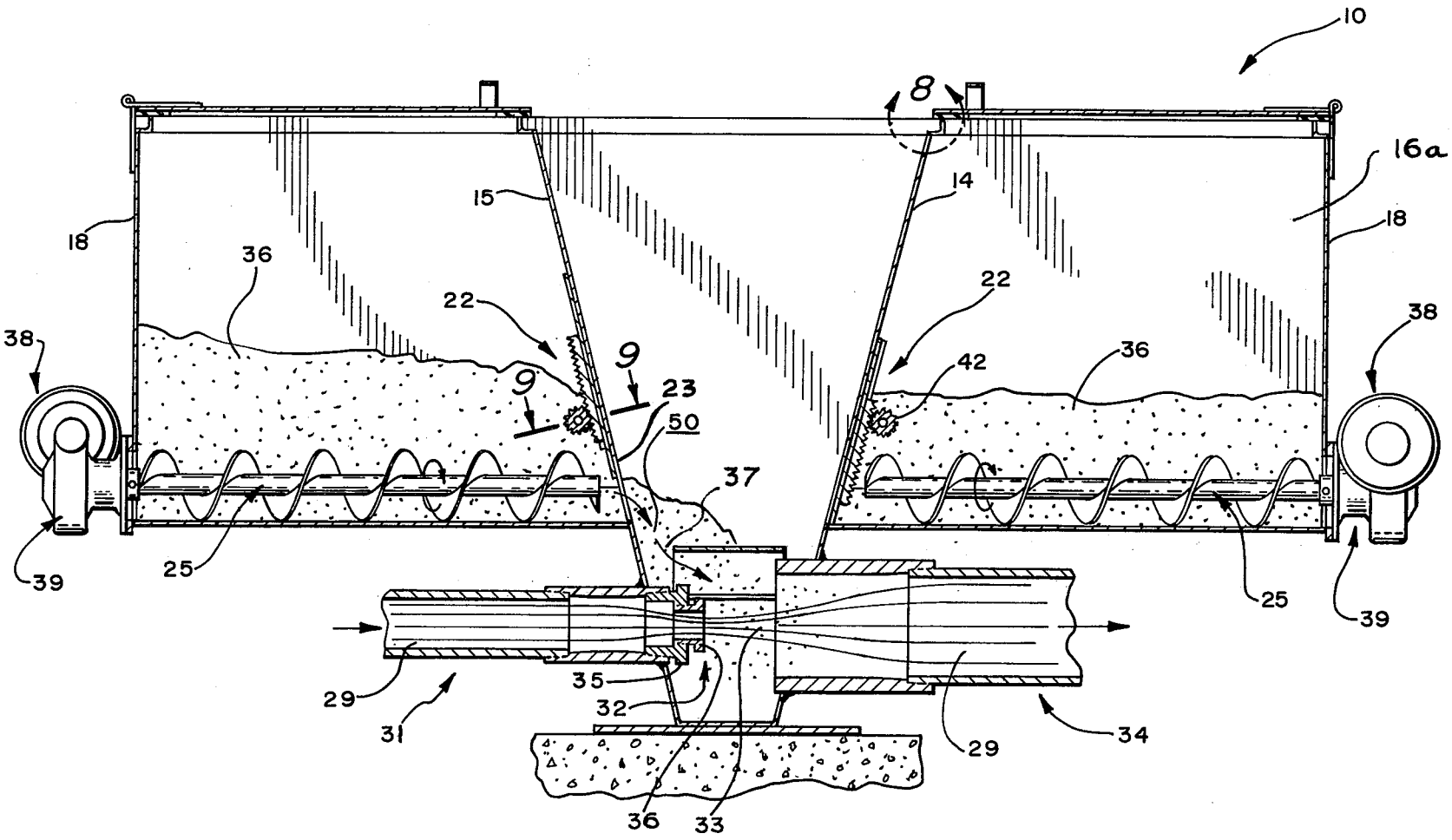
Figure 9:
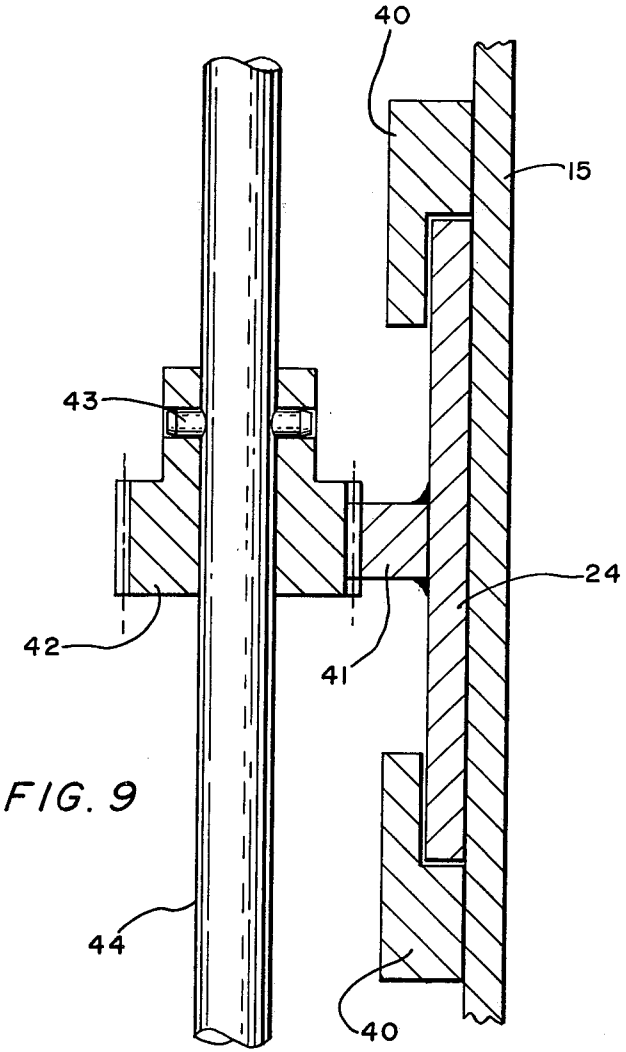
Figure 8:
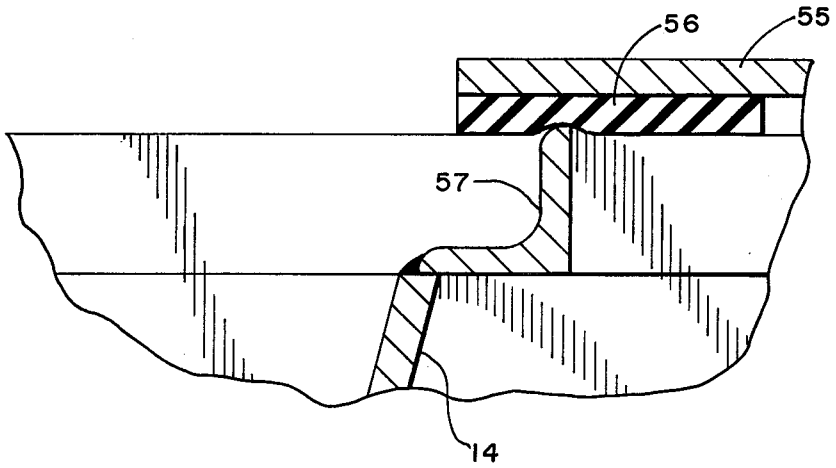
Figure 7:
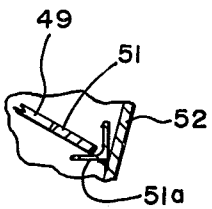
Figure 6:
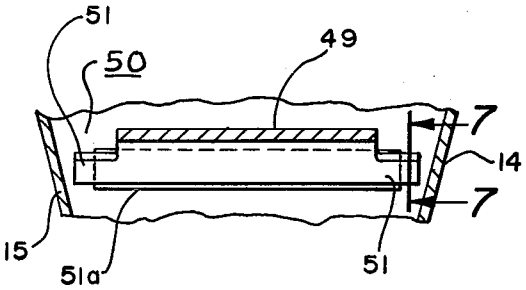

The apparatus 10 for conditioning oil well drilling fluid (mud) comprises an additive entrainment chamber 11 along with, for example, two additive feed hoppers 12 and 13. (FIGS. 1-5), all preferably constructed of metallic plate. Hoppers 12 and 13 in this illustrated embodiment each has a common wall 14 and 15 respectively with chamber 11. Downwardly converging side walls 16 and 17 and 16*a* and 17*a* join with end walls 19 and 18 respectively. Each feed hopper 12 and 13 has a preferably semicircular bottom 20 and 21 respectively, which may for convenience be of a section of steel pipe. An adjustable gate valve 22 in each hopper comprises an aperture 23, triangular in this illustrated embodiment, through the adjacent common wall of chamber 11, along with a movable gate 24 by which the area of aperture 23 is adjusted. A material transporting auger 25 is situated in the bottom of each hopper, aligned with aperture 23 and generally resting within the semicircular hopper bottom. Conditioner 10 is supported upon a suitable foundation, such as concrete slab 26, by a base plate 27 secured as by welding to entrainment chamber 11, closing its bottom, and secured to slab 27 by anchor bolts 28.

Drilling mud 29 is impelled from a mud reservoir 30, through inlet piping 31 and a nozzle 32 by a high pressure pump 30*p* (FIG. 10) to emerge as a high velocity jet 33 across the bottom of entrainment chamber 11. The jet 33 is collected by enlarged outlet piping 34, to be returned to reservoir 30. Nozzle 32 may be conveniently made up of standard pipe reducers 35 and 35*a*. Jet 33, because of its high velocity, entrains substantial amounts of air from chamber 11, creating an adjacent region of reduced pressure. Finely divided dry additive 36 which may be introduced into chamber 11 is thus entrained into jet 33 and drawn into outlet 34, to be thoroughly mixed with mud 29. A supply of such additive 36 is placed in one or both of the hoppers, and fed through aperture 23 of gate valve 22 (Arrows 37) by action of auger 25, powered by an engine 38 acting through a gear reducer 39. The rate of feed of additive 36 into chamber 11 is controlled by selective positioning of gate 24 over aperture 23 to control its area.

Gate 24 of gate valve 22 is guided slideably along chamber wall 14 by retaining blocks 40, and is driven by means of a rack 41 by a pinion gear 42 secured by a pin 43 to a rotatable shaft 44. Shaft 44 is carried by bearing blocks 45, and has a crank 46 equipped with a pointer 47. An indicator dial 48 affixed as to chamber 11 permits calibration of the setting of gate valve 22 for flow rate of each selected additive 36.

Preferably, a canopy plate 49 is provided generally covering jet 33, allowing the additive powder 36 to be drawn into jet 33 through openings 50 between each of its ends and the chamber walls. (FIGS. 4–7) Canopy 49 prevents the entry of large foreign objects downwardly into the jet 33. Such objects would create violent splashing of the mud of the jet, destroying the jet and preventing proper entrainment of the additive. Tabs 51 assure that openings 50 are not closed by any shifting of canopy 49, which rests upon angles 51*a* secured as by welding to side walls 52 and 53 of chamber 11.

Hinged hopper lids 54 are provided to prevent any entry of water or other foreign materials into the additive 36 in hoppers 12 and 13, each comprising a plate 55 with a peripheral gasket 56 adapted to rest upon angles 57 welded about the upper periphery of each hopper. Handles 58 and hinges 59 may be provided. (FIGS. 1–5,8) A vibrator 60 may be secured to the hopper to assure the proper settling of additive 36 about augur 25. A suitable timer, not shown, could be employed to permit selectable intermittent feed of additive 36 into chamber 11, providing further versatility to conditioner 10.

Figure 10:
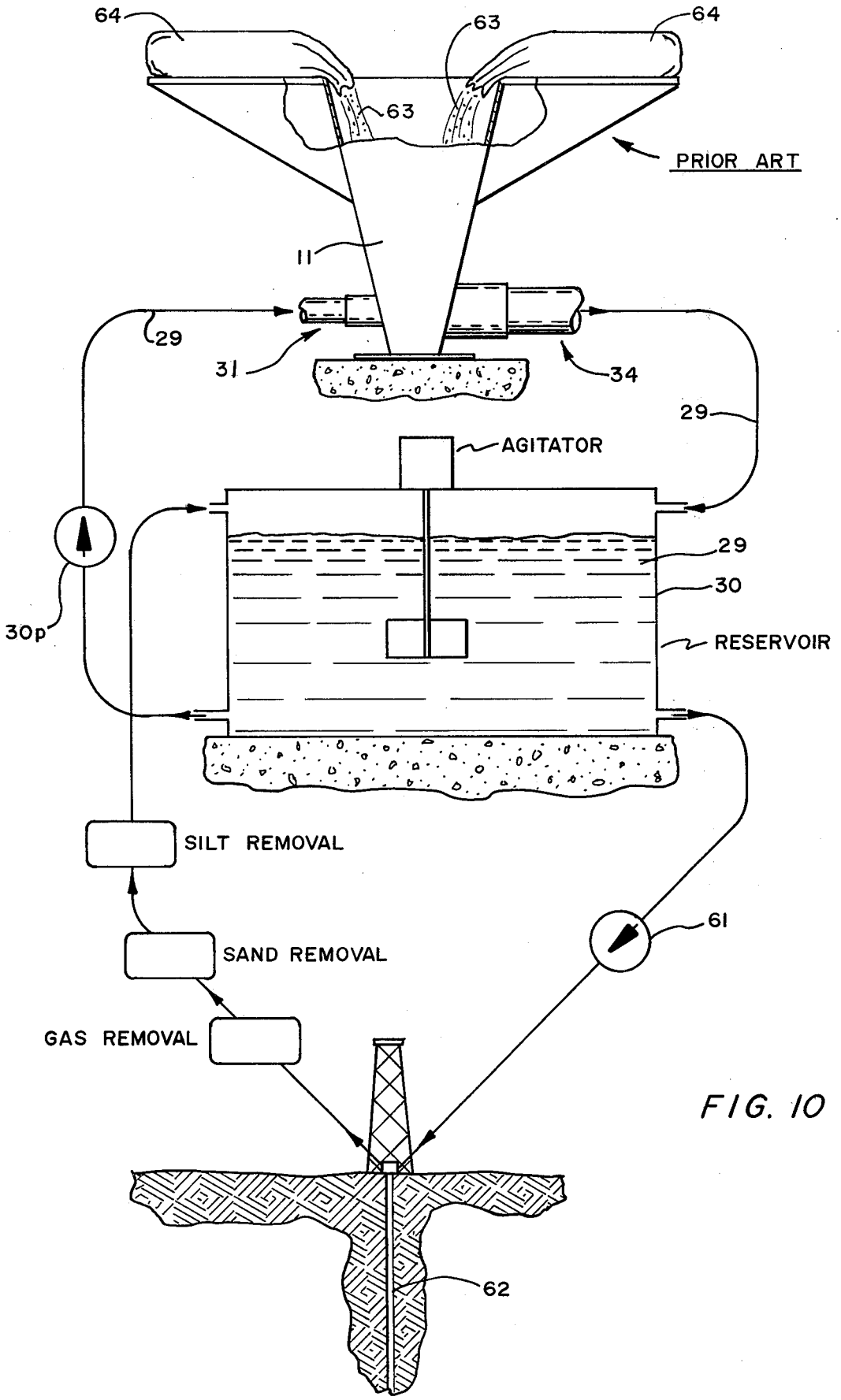
Figure 12:
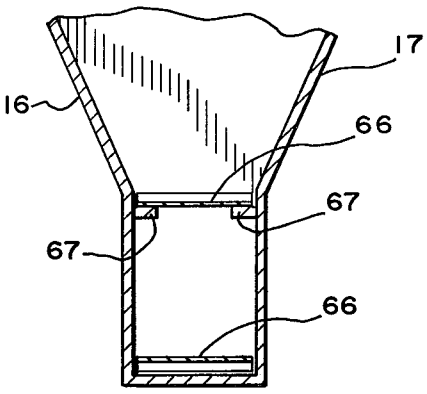

Mud conditioner 10 permits controlled incorporation of the individual additives 36 into the mud, in selected proportions as required to produce desired properties in conditioned mud 29. In FIG. 10, the prior method of reconditioning used drilling fluid is schematically illustrated. The mud is typically stored in reservoir 30, from which it is forced by a high pressure well pump 61 into a drill stem, not shown, in well bore 62, to cool, lubricate and clean the drill cutting head, not shown. Subsequently, the mud is forced upward through bore 62, carrying loose material out of the well. Accumulated sand, silt, and entrained air and other gases are removed, before the mud is returned to reservoir 30. Preferably, physical and chemical tests are then performed to determine the properties of the used mud, including viscosity, density and ph values. The types and amounts of required additives to recondition the mud for further use are then calculated. Solid components in the drilling fluid typically include materials from among powdered tree bark, ligonite, soap or other lubricant, starches, calcium sulphite, borite, and caustic soda. After the required additives and amounts are determined, the used mud is forced by the high pressure entrainment pump 30*p* to jet across the entrainment chamber 11, the selected additives being in this prior art process manually poured in streams 63 from supply bags 64, to be entrained by the mud jet 33. Typically, two additive materials are poured simultaneously, each at a rate estimated by the operator to provide the previously calculated desired amount to achieve the desired properties in the reconditioned mud. With this process, it is not possible to introduce the additives at precise rates, nor to maintain substantially constant rates. Further physical and chemical testing may be required, and the additives entrainment process repeated, to compensate for inaccuracies in additives. With the present method and apparatus, the precise, metered introduction of the additives at calculated required rates substantially eliminates the present need for repeated recirculation and entrainment cycles to adjust the additive amounts.

Figure 11:
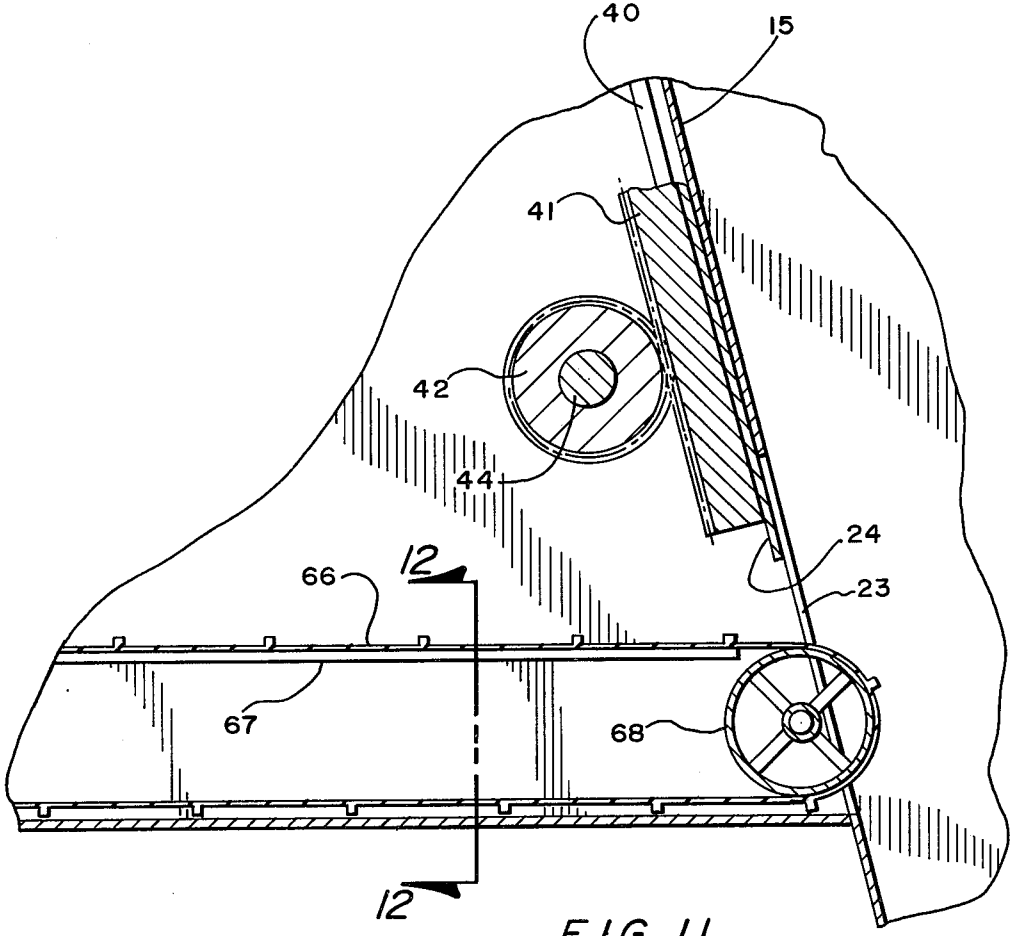

Variations may be made in the illustrated embodiments without departing from the spirit of the invention. For example, the required control of additive flow rate from the hoppers into the entrainment chamber could be accomplished by using a fixed area aperture 23, without the illustrated gating arrangement 22, but with engine 38 selected to be of the variable speed type, so that the rate of rotation of augers 25 could be selected to produce the desired additive feed rate through fixed area aperture 23. An endless belt conveyor 65 could be utilized (FIG. 11) instead of auger 25, conveyor 65 extending through a rectangular aperture 23 into entrainment chamber 11, and gate 24 being employed to control the additive feed rate by selective positioning to adjust the area of aperture 23 above endless belt 66. Belt 66 could be of the flexible material type as illustrated or of the common chain type. The illustrated downwardly converging, plane sided hopper configurations are not essential to the invention. The hoppers need not share common walls with the entrainment chamber, and could be positioned remotely therefrom, with connecting passage means thereto. Stainless steel, or steel with corrosion resistant coatings are preferably utilized for all components of conditioner 10.

The invention may therefore be embodied in other specific forms without departing from the spirit or essential characteristics thereof. The present embodiment is therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by United States Letters Patent is:

1. In a device for entraining finely divided dry additives into oil well drilling mud, said device comprising an entrainment chamber and pumping, piping and nozzle means for producing a high velocity free jet of the mud across and through the chamber, the improvement comprising:

at least one hopper for containing a supply of dry additive;

means for transporting the additive from the hopper into the entrainment chamber, comprising additive passage means between the hopper and the chamber and means for urging the additive in the hopper to and through the passage means at selected rates to be entrained and mixed within the mud of the jet; and the passage means is adjustable in area.

2. The improvement of claim 1, wherein:

the passage means includes gate means movable across the passage opening so that the area of the passage opening may be adjusted; and the additive urging means comprises an auger within the hopper and power means for the rotation thereof.

3. The improvement of claim 2, wherein:

the hopper shares a common wall with the entrainment chamber;

the adjustable passage opening comprises an aperture through the common wall; and the gate means comprises a plate member guided to slide across the aperture and means for positioning the plate adjustably with respect to the aperture.

4. The improvement of claim 3, wherein:

the plate member positioning means comprises means indicating the position thereof with respect to the aperture.

5. The improvement of claim 4, wherein:

the plate member positioning means comprises a rack gear secured thereto, a pinion gear meshing with the rack gear and secured to a rotatable shaft extending to the exterior of the additive entraining device and having exterior rotational position indicating means.

6. The improvement of claim 3, further comprising:

canopy means within the additive entrainment chamber positioned to cover a substantial portion of the jet.

7. The improvement of claim 6, further comprising:

vibrator means secured to the hopper for settling the dry additive about the auger.

8. The improvement of claim 3, wherein:

the hopper further comprises a covering lid for excluding entry of water and other foreign materials into the hopper.

9. The improvement of claim 6, further comprising:

timing means controlling the auger power means, so that the auger may be made to operate during periods of selective duration at selected intervals.

10. In a device for entraining finely divided dry additives into oil well drilling mud, said device comprising an entrainment chamber and pumping, piping and nozzle means for producing a high velocity free jet of the mud across and through the chamber, the improvement comprising:

at least one hopper for containing a supply of dry additive;

means for transporting the additive from the hopper into the entrainment chamber, comprising additive passage means between the hopper and the chamber and means for urging the additive in the hopper to and through the passage means at selected rates to be entrained and mixed within the mud of the jet; wherein the passage means is of fixed area; and the additive urging means is controllable, so that the additive may be forced through the fixed area passage means at adjustable selected rates.

11. The improvement of claim 10, wherein:

the additive urging means comprises an auger within the hopper and power means for the rotation thereof at selectable rates, so that the additive may be urged through the passage means at selectable rates.

12. In a device for entraining finely divided dry additives into oil well drilling mud, said device comprising an entrainment chamber and pumping, piping and nozzle means for producing a high velocity free jet of mud across and through the chamber, the improvement comprising:

at least one hopper for containing a supply of dry additive;

means for transporting the additive from the hopper into the entrainment chamber, comprising additive passage means between the hopper and the chamber and means for urging the additive in the hopper to and through the passage means at selected rates to be entrained and mixed within the mud of the jet;

wherein the additive transporting means comprises additive passage means between the hopper and the entrainment chamber and belt conveyor means extending from the hopper through the passage means into the entrainment chamber.

13. The improvement of claim 12, wherein:

the passage means is adjustable in area.

14. The improvement of claim 13, wherein:

the passage means is of fixed area; and the conveyor means may be operated at selected rates.

15. The improvement of claim 13, wherein:

the passage means includes movable gate means for adjusting the portion of the passage opening above the conveyor means.

16. The improvement of claim 15, wherein:

the hopper shares a common wall with the entrainment chamber;

the adjustable passage opening comprises an aperture through the common wall; and the gate means comprises a plate member guided to slide across the portion of the aperture above the conveyor means, and means for positioning the plate member selectably with respect to said aperture portion.

17. The improvement of claim 16, wherein:

the plate member positioning means comprises means indicating the position thereof with respect to the aperture.

18. The improvement of claim 17, wherein:

the plate member positioning means comprises a rack gear secured thereto, a pinion gear meshing with the rack gear and secured to a rotatable shaft extending to the exterior of the additive entraining device and having exterior rotational position indicating means.

19. The improvement of claim 16, further comprising:

canopy means within the additive entrainment chamber positioned to cover a substantial portion of the jet.

20. The improvement of claim 19, further comprising:

vibrator means secured to the hopper for settling the dry additive about the auger.

21. The improvement of claim 16, whrein:

the hopper further comprises a covering lid for excluding entry of water and other foreign materials into the hopper.

22. The improvement of claim 16, further comprising:

timing means controlling the conveyor power means, so that the conveyor may be made to operate during periods of selectable duration at selected intervals.

23. A method for conditioning oil well drilling mud, comprising:

providing a device for entraining finely divided dry additives into the drilling mud, said device comprising an entrainment chamber and pumping, piping and nozzle means for producing a high velocity free jet of the mud across and through the chamber;

determining the proportions of the dry additives required to be mixed with the mud to condition it to have the required physical and chemical properties;

producing said jet of the mud by operation of the pump;

introducing the dry additives into the entrainment chamber at selected rates to be entrained into the mud of the jet in the pre-determined required proportions thereto; wherein the additive entraining device includes at least one hopper for containing a supply of dry additive, and additive passage means between the hopper and the chamber and means for urging the additive through the means at adjustable selected rates; and wherein the passage means includes adjustable valving means for controlling the rate of additive flow therethrough and means for indicating the rate of additive flow therethrough.

24. The method of claim 23, wherein:

the valving means comprises an adjustable gate valve.

25. The method of claim 24, wherein:

the additive urging means is an auger within the hopper.

26. The method of claim 24, wherein:

the additive urging means comprises belt conveyor means within the hopper.

* * * * *